US008205344B2

(12) United States Patent
Stevens

(10) Patent No.: US 8,205,344 B2
(45) Date of Patent: Jun. 26, 2012

(54) SAFETY RAZOR HAVING PIVOTABLE BLADE UNIT

(75) Inventor: Christopher John Stevens, Reading (GB)

(73) Assignee: The Gillette Company, Boston, MA (US)

( * ) Notice: Subject to any disclaimer, the term of this patent is extended or adjusted under 35 U.S.C. 154(b) by 410 days.

(21) Appl. No.: 12/542,055

(22) Filed: Aug. 17, 2009

(65) Prior Publication Data

US 2010/0043242 A1 Feb. 25, 2010

Related U.S. Application Data

(60) Provisional application No. 61/189,512, filed on Aug. 20, 2008.

(51) Int. Cl.
*B26B 21/52* (2006.01)

(52) U.S. Cl. ..... 30/527; 30/526

(58) Field of Classification Search ..... 30/50, 527, 30/57, 58, 526, 535
See application file for complete search history.

(56) References Cited

U.S. PATENT DOCUMENTS

| | | | | |
|---|---|---|---|---|
| 2,844,870 | A | 7/1958 | Roces et al. | |
| 3,950,848 | A | 4/1976 | Goldstein | |
| 3,964,160 | A | 6/1976 | Gordon | |
| 4,152,828 | A | 5/1979 | Lund | |
| 5,029,391 | A | 7/1991 | Althaus et al. | |
| 5,535,518 | A * | 7/1996 | Althaus | 30/527 |
| 5,560,106 | A | 10/1996 | Armbruster et al. | |
| 5,678,316 | A | 10/1997 | Althaus et al. | |
| 5,771,591 | A | 6/1998 | Armbruster et al. | |
| 5,787,593 | A | 8/1998 | Althaus | |
| 5,953,824 | A | 9/1999 | Ferraro et al. | |
| 6,115,924 | A | 9/2000 | Oldroyd | |
| 6,223,442 | B1 | 5/2001 | Pina | |
| 6,311,400 | B1 | 11/2001 | Hawes et al. | |
| 6,381,857 | B1 | 5/2002 | Oldroyd | |
| 6,615,498 | B1 | 9/2003 | King et al. | |
| 6,880,253 | B1 | 4/2005 | Gyllerstrom | |
| 7,137,205 | B2 | 11/2006 | Royle | |
| 2004/0177519 | A1 * | 9/2004 | Tomassetti et al. | 30/527 |

OTHER PUBLICATIONS

PCT International Search Report with Written Opinion in corresponding Int'l appln. PCT/US2009/054373 dated Dec. 22, 2009.

* cited by examiner

*Primary Examiner* — Sean Michalski
(74) *Attorney, Agent, or Firm* — John M. Lipchitz; Kevin C. Johnson; Steven W. Miller

(57) ABSTRACT

A safety razor having a blade unit has at least one blade and a handle casing. A pivotal connection structure is disposed between the blade unit and the handle casing. A first member is connected to the blade unit and a second member is connected to the handle casing. A joint member connects the first member and the second member and facilitates movement of the first member relative to the second member about a hinge axis that is substantially perpendicular to the at least one blade.

19 Claims, 9 Drawing Sheets

SAFETY RAZOR HAVING PIVOTABLE BLADE UNIT

CROSS REFERENCE TO RELATED APPLICATION

This application claims the benefit of U.S. Provisional Application No. 61/189,512, filed on Aug. 20, 2008.

FIELD OF THE INVENTION

The present invention relates to safety razors including a handle unit and a blade unit having at least one blade. More particularly, the present invention relates to a safety razor having the blade unit being connected to the handle unit for a pivotal movement relative thereto about a pivot axis substantially perpendicular to the blade for following the skin contours of a user during shaving.

BACKGROUND OF THE INVENTION

Conventional safety razors have a blade unit connected to a handle for a pivotal movement about a single pivotal axis which is substantially parallel to the blade or the blade edge. For example, U.S. Pat. Nos. 7,197,825 and 5,787,586 disclose such a razor having a blade unit capable of a pivotal movement about a pivot axis substantially parallel to the blade(s). The pivotal movement about the single axis provides some degree of conformance with the skin allowing the blade unit to easily follow the skin contours of a user during shaving. The pivot axis, which usually extends parallel to the cutting edges of the blades, can be defined by a pivot structure where the handle is connected to the blade unit. Such safety razors have been successfully marketed for many years. However, the blade unit often disengages from the skin during shaving as it has limited ability to pivot about the single axis.

To address this problem, it was suggested that the blade unit can additionally pivot about another axis which is substantially perpendicular to the blade(s). For example, U.S. Pat. No. 5,029,391 discloses such a razor having a blade unit capable of a pivotal movement about a pivot axis substantially perpendicular to the blade(s). It is disclosed that the blade unit can carry out a pivoting movement about two axes, so that the safety razor blade unit can optimally conform to the contour of the face during shaving. Other examples of safety razors which have a blade unit capable of pivotal movements about two pivot axes are disclosed in U.S. Pat. Nos. 6,615,498; and 5,953,824; and Japanese Patent Laid Open Publication Nos. H2-34193; H2-52694; and H4-22388.

While it is disclosed that these razors help the blade unit to more suitably follow the skin contours of a user, they tend to have a complicated structure to implement the pivotal movements about two pivot axes and thus cause a difficulty in manufacturing.

Thus, there is a need for a safety razor having a blade unit capable of a pivotal movement about a pivot axis substantially perpendicular to the blade by a simpler manufacturing process, compared to the prior art technologies. There is also a need for a shaving cartridge having a blade unit capable of a pivotal movement about a pivot axis substantially perpendicular to the blade by a simpler manufacturing process, compared to the prior art technologies.

SUMMARY OF THE INVENTION

In one aspect, the invention is directed to a safety razor which includes a blade unit having at least one blade, a handle unit having a handle casing, and a pivotal connection structure disposed between the blade unit and the handle casing. The blade unit is connected to the handle casing through the pivotal connection structure for a pivotal movement relative thereto about a perpendicular pivot axis which is substantially perpendicular to the at least one blade for following the skin contours of a user during shaving.

The pivotal connection structure includes (a) a first member connected to the blade unit, the first member having a joint portion, (b) a second member connected to the handle casing, the second member having a joint portion, and (c) a joint member for jointing, in a hinged manner, the joint portion of the first member with the joint portion of the second member. The pivotal connection structure is constructed such that the joint member has a hinge axis disposed between the joint portions of the first and second members, which works as the perpendicular pivot axis. The joint member has a thinner wall section toward the hinge axis than toward at least one of the joint portions of the first and second members.

In another aspect, the invention is directed to a safety razor having a blade unit with at least one blade and a handle casing. A pivotal connection structure is disposed between the blade unit and the handle casing. A first member is connected to the blade unit and a second member is connected to the handle casing. A joint member connects the first member and the second member and facilitates movement of the first member relative to the second member about a hinge axis that is substantially perpendicular to the at least one blade.

In another aspect, the invention is directed to a handle unit for a safety razor, to be attached to a shaving cartridge which includes a blade unit. The blade unit includes at least one blade, while the handle unit includes a handle casing and a pivotal connection structure connected to the handle casing.

In a yet another aspect, the invention is directed to a shaving cartridge for a safety razor, which is to be attached to a handle unit of the safety razor. The shaving cartridge includes a blade unit including at least one blade and a pivotal connection structure which is to be connected to the handle unit.

Since the pivotal connection structure for a pivotal movement about the perpendicular pivot axis can be formed by a simple structure, the safety razor can be produced by a simpler manufacturing process, compared to the prior art technologies.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Herein, "comprise" and "include" mean that other elements and/or other steps which do not affect the end result can be added. Each of these terms encompasses the terms "consisting of" and "consisting essentially of".

Herein, "connected" encompasses configurations in which one element is directly secured or mounted to another element by affixing the element directly to the other element; configurations in which the element is indirectly secured or mounted to the other element by affixing the element to an intermediate member which is affixed to the other element; and configurations in which one element is integral with another element, i.e., one element is essentially part of the other element.

Herein, "joint" encompasses configurations in which one element is directly secured or mounted to another element by affixing the element directly to the other element; and configurations in which one element is integral with another element, i.e., one element is essentially part of the other element.

Herein, "shaving cartridge" is a replaceable unit (for a replacement after use) including at least one blade, which can be attached and detached to a handle unit. In one embodiment, the shaving cartridge includes the blade unit while the handle unit includes a pivotal connection structure. In an alternative embodiment, the shaving cartridge includes both a blade unit and a pivotal connection structure.

Figure 1:
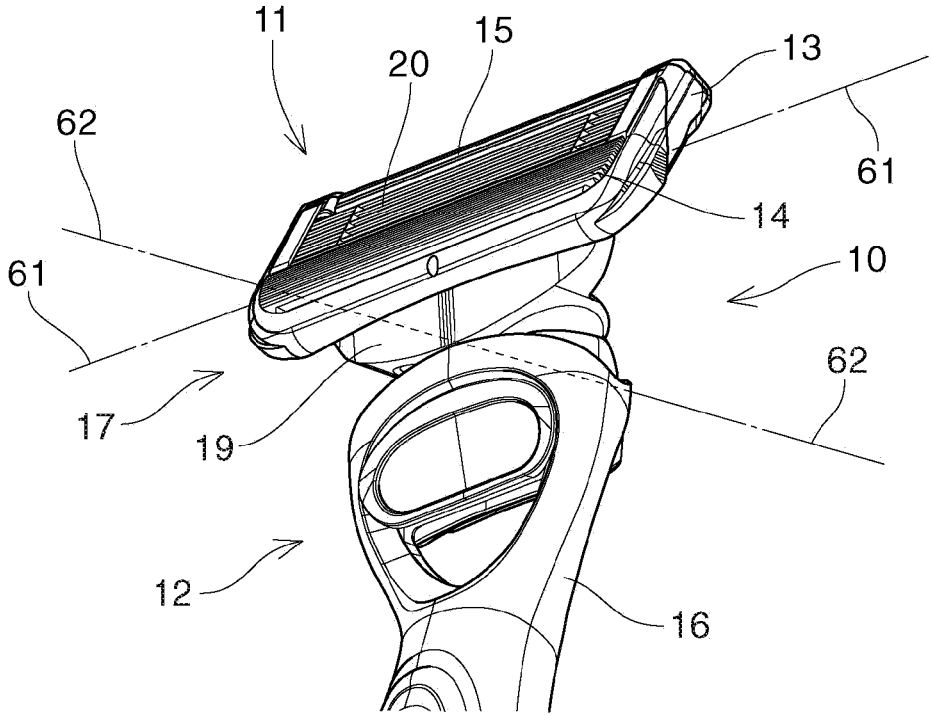
FIG. 1 is a perspective view of a safety razor which is one embodiment of the present invention.

FIG. 1 is a perspective view of a safety razor 10 which is one embodiment of the present invention. Referring to FIG. 1, the safety razor 10 includes a shaving cartridge 17 which includes a blade unit 11 and a connecting member 19. The connecting member 19 detachably connects the cartridge 17 to the handle unit 12. The blade unit 11 is pivotally connected to the connecting member 19. The blade unit 11 includes a frame 13 with a guard 14, a cap 15, and a plurality of blades 20 positioned between the guard 14 and cap 15 with their cutting edges parallel to each other, as well known in the art. The safety razor 10 further includes a handle unit 12 which includes a handle casing 16.

The safety razor 10 further includes a pivotal connection structure 30 (not shown in FIG. 1 but FIG. 3) disposed between the blade unit 11 (more specifically, the connecting member 19) and the handle casing 16. The pivotal connection structure 30 works to connect the blade unit 11 with the handle unit 12.

The blade unit 11 has a structure for a pivotal movement about a first pivot axis (or, "parallel pivot axis") 61 which is substantially parallel to the edges of the blades 20. The first pivot axis 61 is preferably in front of the blades 20 and below a plane tangential to the guard 14 and cap 15 surfaces, although other pivot positions are possible.

The blade unit 11 is connected to the handle casing 16 through the pivotal connection structure 30 for a pivotal movement relative thereto about a second pivot axis (or, "perpendicular pivot axis") 62 which is substantially perpendicular to the blades 20 for following the skin contours of a user during shaving. The blade unit 11 has a rest position towards which the blade unit 11 is biased by a return force when pivoted about the second pivot axis 62 away from the rest position.

Figure 2:
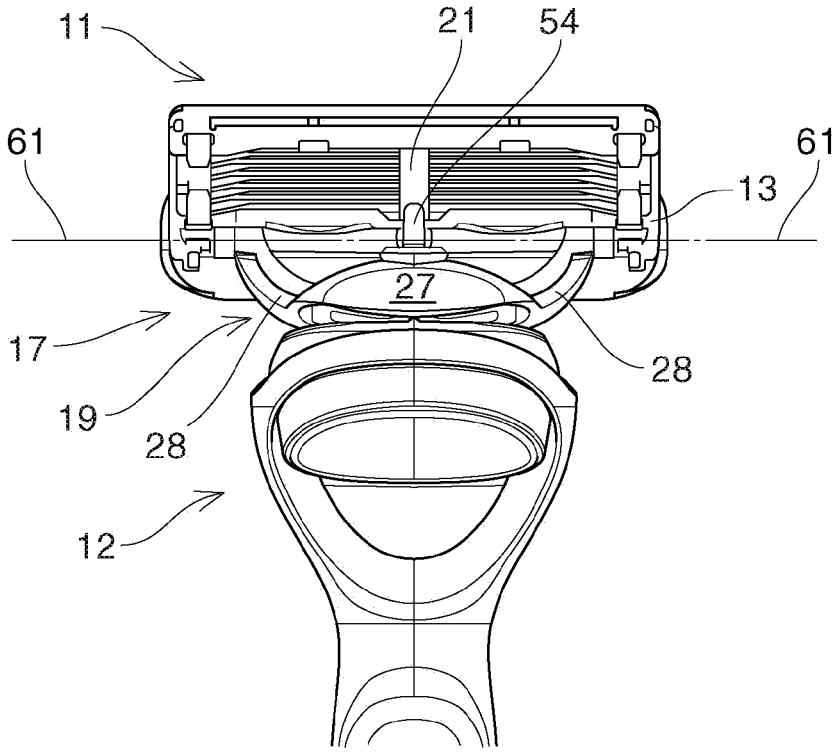
FIG. 2 is a rear view of the blade unit shown in FIG. 1.

FIG. 2 is a rear view of the safety razor 10 shown in FIG. 1. Referring to FIG. 2, the safety razor 10 includes the cartridge 17 which includes the blade unit 11 and the connecting member 19. The connecting member 19 detachably connects the cartridge 17 to the handle unit 12. The blade unit 11 is pivotally connected to the connecting member 19. The blade unit 11 includes the frame 13 which has a cam surface 21. The safety razor 10 includes a spring-biased plunger 51 (not shown in FIG. 2 but FIG. 3) which has a rounded distal end 54.

The connecting member 19 has a body 27 and a pair of arms 28 extending outwardly from the body 27. Each of the arms 28 has a finger 29 (not shown in FIG. 2 but FIG. 3) which is pivotally connect to the blade unit 11 by insertion into pivot bearings (not shows in FIG. 2) formed in the frame 13 of the blade unit 11, and allow the blade unit 11 to pivot about the axis 61 relative to the handle unit 12.

Before shaving starts, the blades 20 are in the rest position. During shaving, the blades 20 are movable independently of each other and are urged upwardly with respect to a plane tangential to the surfaces of the guard 14 and cap 15 by springs (not shown) which determine a return force of the blades 20 against the skin.

In addition, the blade unit 11 pivots about the first pivot axis 61 in response to the force applied from the skin and the return force during shaving. For example, when the blade unit 11 is biased toward an upright rest position by the spring-biased plunger 51, the distal end 54 of the plunger 51 contacts the cam surface 21 at a location spaced from the pivot axis 61 to impart a biasing force to the frame 13. Locating the plunger/cam surface contact point spaced from the pivot axis 61 provides leverage so that the spring-biased plunger 51 can return the blade unit 11 to its upright, rest position upon load removal. This leverage also enables the blade unit 11 to pivot freely between its upright and fully loaded positions in response to a changing load applied during shaving from the user's skin.

The return force generated by the springs can be either linear or non-linear acting to return the blade unit 11 to the rest position. The torque range of the return force is from about 0 to about 15 Nmm as the blade unit 11 pivots from its rest position about the first pivot axis 61 through the complete pivot range. Other torque ranges both larger and smaller may be used as desired. The torque can be varied by varying the physical property of the springs used. Preferably, the blade unit 11 has a pivot range up to about 45° about the first pivot axis 61. Other pivot ranges both larger and smaller may be used as desired.

Figure 3:
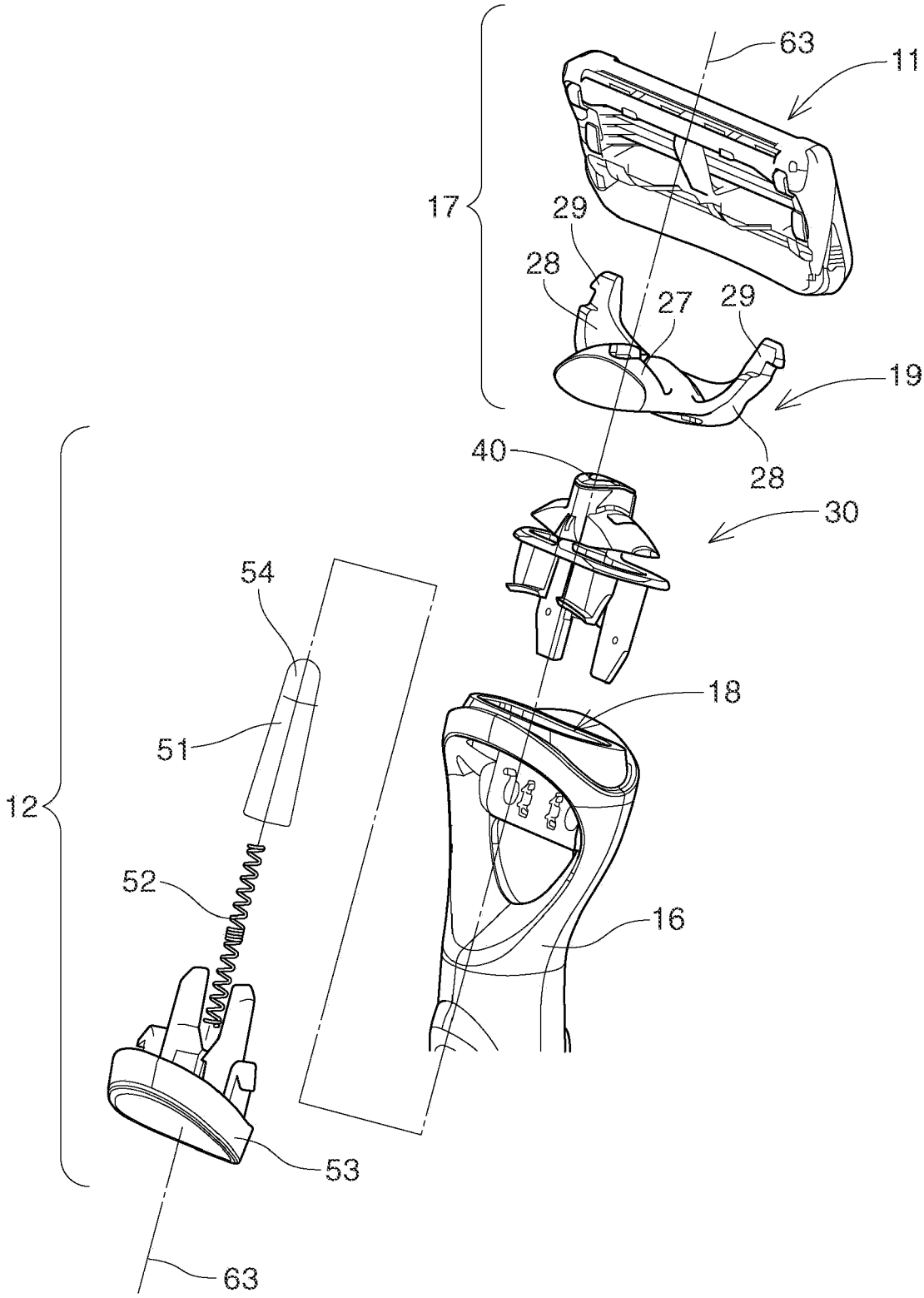
FIG. 3 is an exploded perspective view of a subassembly of the safety razor shown in FIG. 1.

FIG. 3 is an exploded perspective view of a subassembly of the safety razor 10 shown in FIG. 1. Referring to FIG. 3, the cartridge 17 includes the blade unit 11 and the connecting member 19. In this embodiment, the handle unit 12 includes the pivotal connection structure 30 and the handle casing 16 which has a handle opening 18. The handle opening 18 has enough dimension and shape to contain the pivotal connection structure 30. The handle unit 12 further includes a plunger 51 having a distal end 54, a spring 52, and a release button 53. The pivotal connection structure 30, the plunger 51, the spring 52, and the release button 53 are disposed along a common longitudinal central axis 63.

The connecting member 19 has the body 27 and the pair of arms 28 extending outwardly from the body 27. Each of the arms 28 has a finger 29 which is pivotally connect to the blade unit 11 by insertion into pivot bearings (not shows in FIG. 3) formed in the back of the frame 13 of the blade unit 11.

Figure 4:
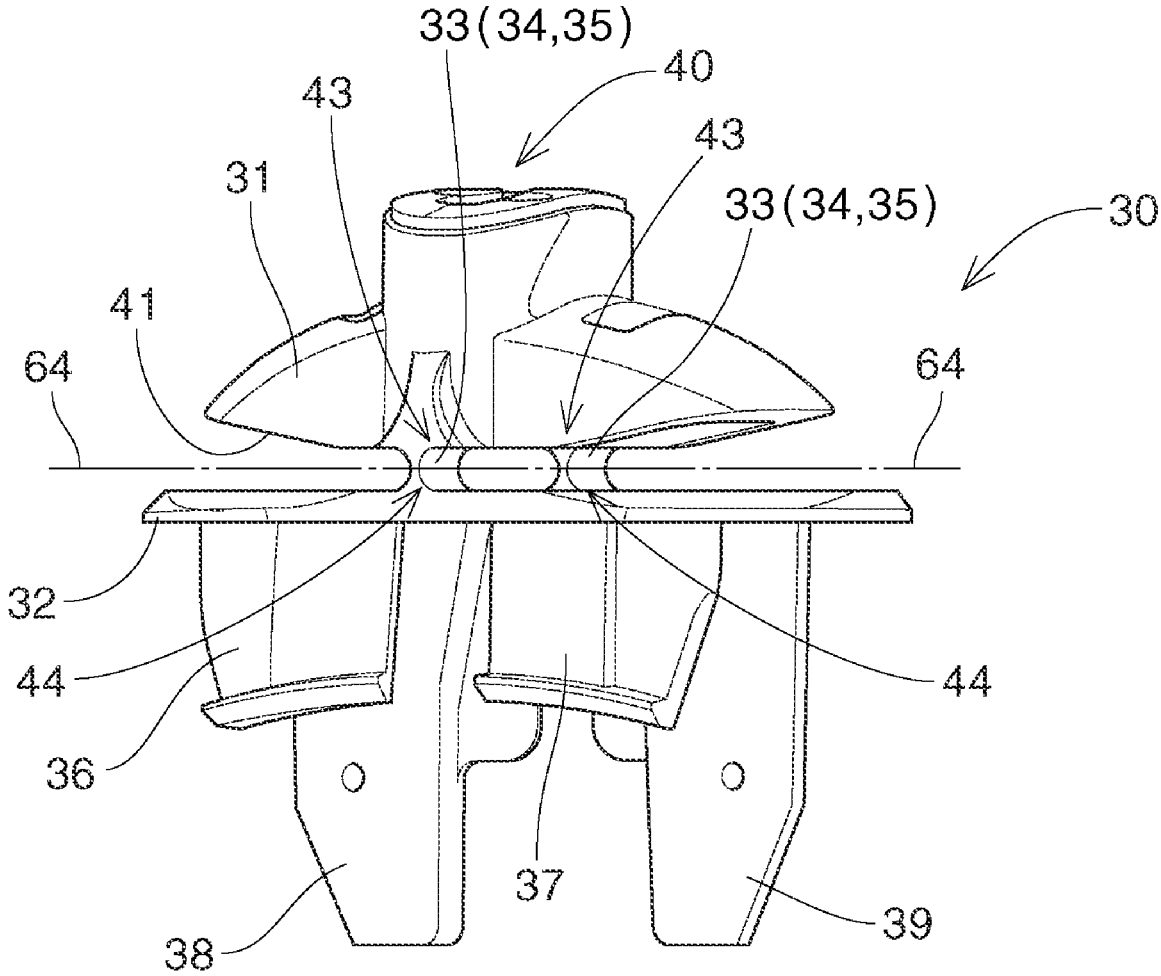
FIG. 4 is a perspective view of the pivotal connection structure shown in FIG. 3.

FIG. 4 is a perspective view of the pivotal connection structure 30 shown in FIG. 3. Referring to FIG. 4, the pivotal connection structure 30 includes (a) a first member 31 which is connected to the blade unit 11(through the cartridge 17), and (b) a second member 32 which is connected to the handle casing 16. Each of the first and second members 31 and 32 has joint portions 43 and 44. The pivotal connection structure 30 further includes (c) a joint member 33 for jointing, in a hinged manner, the joint portions 43 of the first member 31 with the joint portions 44 of the second member 32.

Herein, "in a hinged manner" means that two separate members are jointed by a third member wherein the two separate members are movable about a pivot axis which penetrates the third member. This pivot axis is also called "hinge axis".

The pivotal connection structure 30 is constructed such that the joint member 33 has a hinge axis 64 disposed between the joint portions 43 and 44 of the first and second members 31 and 32, which works as the perpendicular pivot axis 62 shown in FIG. 1. The joint member 33 can be formed by (or, include) either a single joint element or a plurality of (e.g., two or more) separated joint elements which is (or are) disposed along the hinge axis 64 or the perpendicular pivot axis 62. In certain embodiments, the plurality of joint members 33 may be separated by about 1mm, 1.5 mm, or 2.5 mm to about 3.0 mm, 3.5 mm or 4.0 mm to allow for the positioning of the spring-biased plunger 51 and/or a release mechanism between the joint members 33. Such a plurality of separated joint elements can be formed by either an identical material or different materials on each element.

The joint member 33 may have a thinner wall section toward the hinge axis 64 than toward at least one of the joint portions 43 and 44 of the first and second members 31 and 32 to facilitate movement of the first member 31 relative to the second member 32 about a single axis (i.e., the hinge axis 64). In certain embodiments, the joint member 33 may have a thinner wall section toward the hinge axis 64 than toward either of the joint portions 43 and 44 of the first and second members 31 and 32 (e.g., a living hinge). The thinner wall section toward the center of the joint member 33 may allow for a more precise and controllable location of the pivot axis 64. For example, if the joint member 33 has a uniform wall section, the location of the pivot axis 64 may vary significantly between the joint portions 43 and 44. The joint member 33 may have a wall thickness towards its center of about 0.10 mm, 0.20 mm, or 0.25 mm to about 0.40 mm, 0.55 mm, or 0.70 mm. The joint member 33 may also be concave or have a radius to facilitate repeated flexing of the joint member without cracking or breaking. The wall thickness may increase toward the joint portions 43 and 44 to about 0.8 mm, 0.9 mm, or 1.0 mm to about 1.5 mm, 2.0 mm, or 3.0 mm. The position of the pivot axis 64 may be less repeatable with longer joint members 33. In certain embodiments, a distance between the joint portions 43 and 44 (i.e., height of joint portions 43 and 44) may be minimized to further control the position of the hinge axis 64 and prevent buckling of the joint members 33. For example, the distance between the joint portions 43 and 44 may be about 0.5 mm, 0.75 mm, or 1.0 mm to about 1.25 mm, 1.5 mm, or 2.0 mm.

In the embodiment shown in FIG. 4, the joint member 33 (as a whole) has an elongated shape such that it constitutes the hinge axis 64 disposed between the joint portions 43 and 44 of the first and second members 31 and 32. The joint member 33 includes two separated joint elements 34 and 35 which are disposed along the hinge axis 64. The two separated joint elements 34 and 35 constitute the joint member 33. The hinge axis 64 coincides with the second axis 62 (i.e., the perpendicular pivot axis) shown in FIG. 1. In order to constitute the pivotal connection structure 30 for a pivotal movement about the perpendicular pivot axis 62, it should be noted that the first and second members 31 and 32 are jointed only by the joint member 33 (i.e., the two separated joint elements 34 and 35 in the embodiment shown in FIG. 4). In other words, there is no other element(s) which joints or connects the first member 31 to the second member 32.

In an alternative embodiment, the joint member 33 can be formed by a unitary material (i.e., one elongated element, instead of two or more separated joint elements 34 and 35) disposed along the hinge axis 64 (not shown in Figs.).

In one embodiment, at least one of the first and second members has a convexly curved face facing the other of the first and second members. In the embodiment shown in FIG. 4, the first member 31 has a convexly curved face 41 facing the second member 32. The convexly curved face 41 has a spherical convex shape. The formation of the convexly curved face 41 at the first member 31 can facilitate a wider range of the pivotal movement at the pivotal connection structure.

The pivotal connection structure 30 further includes a pair of latch arms 36 and 37 that help secure the pivotal connection structure 30 to the handle casing 16, and a pair of guide members 38 and 39 that help guide the movement of the release button 53 when it is actuated. The pivotal connection structure 30 has a slot 40 in which the distal end 54 of the plunger 51 can penetrate.

Figure 7:
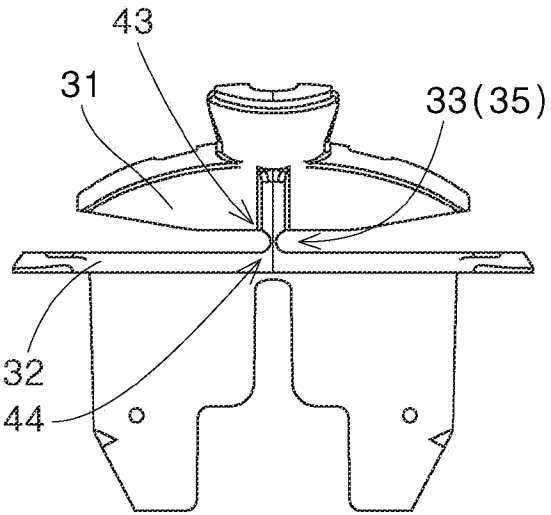
FIG. 7 is a rear view of the pivotal connection structure shown in FIG. 3.
Figure 6:
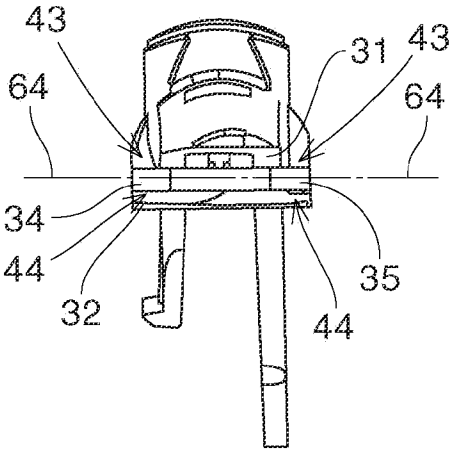
FIG. 6 is a side view of the pivotal connection structure shown in FIG. 3.
Figure 5:
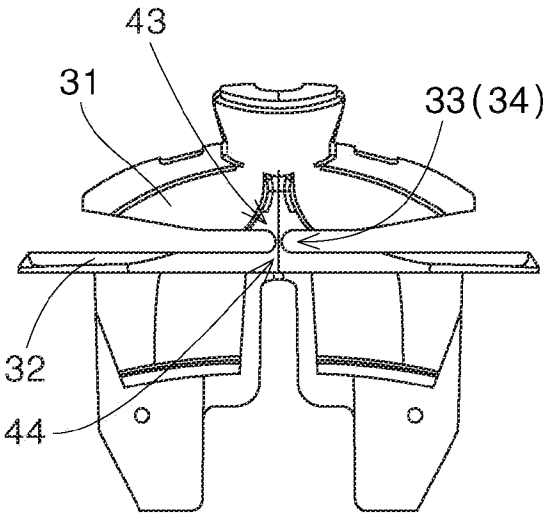
FIG. 5 is a front view of the pivotal connection structure shown in FIG. 3.

FIGS. 5, 6 and 7 are front, side and rear views of the pivotal connection structure 30 shown in FIG. 3, respectively. Referring to FIGS. 5, 6 and 7, the pivotal connection structure 30 includes the first member 31, the second member 32, and the joint member 33. The joint member 33 has the hinge axis 64 (not shown in FIGS. 5 and 7 but FIG. 6) disposed between the joint portions 43 and 44 of the first and second members 31 and 32. The joint member 33 has the two separated joint elements 34 and 35 disposed along the hinge axis 64 as shown in FIG. 6.

Since the pivotal connection structure 30 for a pivotal movement about the perpendicular pivot axis 62 can be formed by a simple structure, the safety razor can be produced by a simpler manufacturing process, compared to the prior art technologies.

The joint member 33 (e.g., the joint elements 34 and 35) is formed by a resilient material. Such a resilient material can include a thermo plastic material, a rubber material, a metal material, or the like. Applicable thermo plastic materials for the joint member 33 include, but not limited to, polyamide (nylon); polypropylene; polyester; polyethylene; and styrene ethylene butylene styrene (SEBS).

In one embodiment, the first member 31, the second member 32 and the joint member 33 are formed by an identical material. In the embodiment shown in FIG. 4, the first member 31, the second member 32 and the joint member 33 may be formed by a thermoplastic material, for example, polyoxymethylene (POM) copolymer which is available from Ticona Engineering Polymers Corporation, under Code No. Hostaform C 9021. It is understood that other thermoplastic materials may also be used, including, but not limited to nylon, polyethylene, and polypropylene, and acrylonitrile butadiene styrene (ABS). The thermoplastic material of the joint member 33 may provide sufficient flexibility for pivoting while preventing fatigue or premature failure of the joint member 33 over numerous cycles of pivoting about the hinge axis 64.

Alternatively, the first member 31, the second member 32, and the joint member 33 can be formed by at least two different materials. In one embodiment, the first member 31 and the second member 32 are formed by an identical material, while the joint member 33 is formed by a different material. For example, the first member 31 and the second member 32 are formed by a thermo plastic material (e.g., polyoxymethylene (POM) copolymer), while the joint member 33 is formed by an adhesive material. Examples of such an adhesive material include a polyurethane adhesive and a methacrylate adhesive which are classed as "structural adhesives".

In the embodiment shown in FIG. 4, the first and second members 31 and 32 and the joint member 33 are formed by an identical material by using an injection molding process of a thermo plastic material. In this embodiment, since the pivotal connection structure 30 can be formed by the injection molding process, the safety razor can be produced by a simpler manufacturing process, compared to the prior art technologies.

If desired, the first member 31, the second member 32, and the joint member 33 can be formed by three deferent materials.

The elastic property of the joint member 33 can vary depending on the material employed and the thickness of the joint member 33. In one embodiment, the resilient material for the joint member 33 is polyoxymethylene (POM) copolymer which is available from Ticona Engineering Polymers Corporation, under Code No. Hostaform C 9021.

Referring back to FIG. 3, to assemble the pivotal connection structure 30 into the handle unit 12, the pivotal connection structure 30 is inserted into the handle opening 18 such that the latch arms 36 and 37 latch against a surface (not shown in Figs.) formed in the handle opening 18 of the handle casing 16. The spring 52 is placed over the cylindrical extension (not shown in FIGS.) which extends from the release button 53. The spring 52 is also inserted into a cavity (not shown in FIGS.) of the plunger 51. The plunger-spring-button assembly is inserted into the handle opening 18 and then the rear portion of the pivotal connection structure 30 such that the distal 54 end of the plunger 51 goes through the slot 40.

Figure 8:
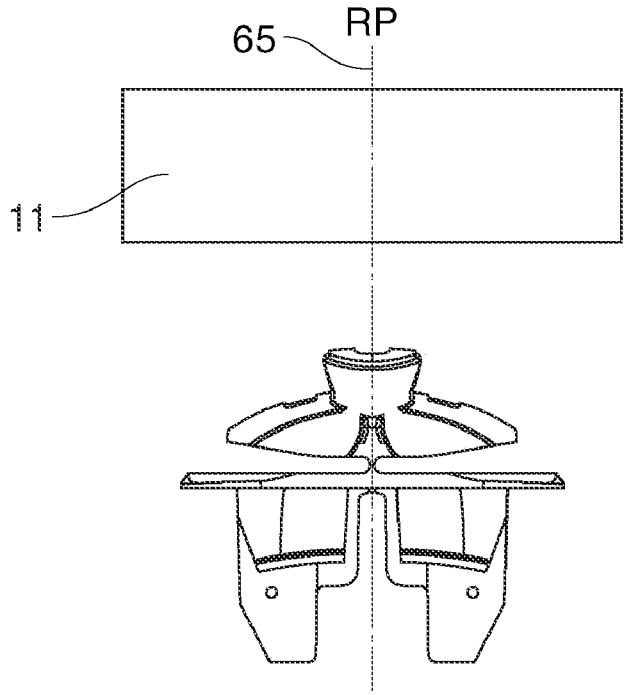
FIGS. 8 and 9 are schematic drawings which explain the function of the pivotal connection structure shown in FIG. 3.
Figure 9:
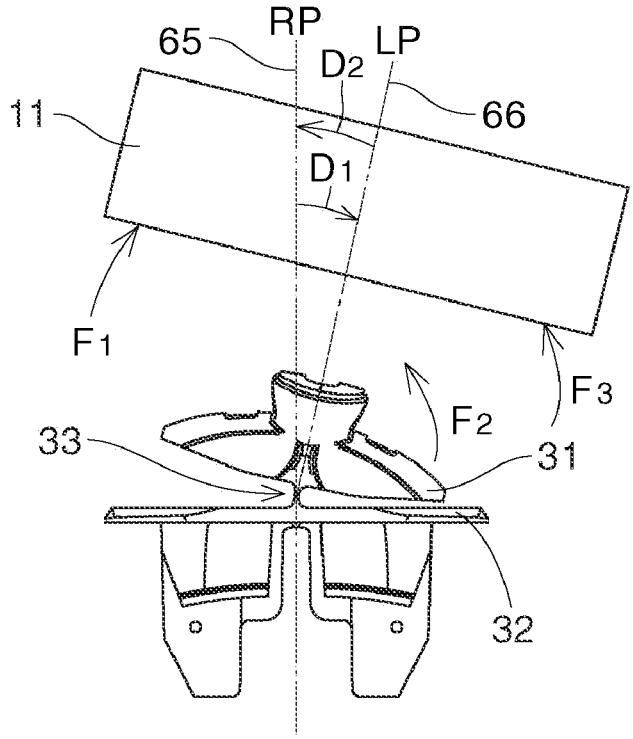

FIGS. 8 and 9 are schematic drawings which explain the function of the pivotal connection structure 30 shown in FIG. 3. These drawings illustrate the relative movements between the blade unit 11 and the pivotal connection structure 30 when the blade unit 11 pivots about the second pivot axis 62 for following the skin contours of a user during shaving. In these drawings, the blade unit 11 has a pivot axis 65 which shows the degree of its lean from the rest position RP. The pivot axis 65 is perpendicular to the second axis 62.

In FIG. 8, since no force is applied from the skin before shaving starts, the blade unit 11 is in the rest position RP and thus the pivot axis 65 is in the rest position RP. In this state, the blade unit 11 is ready for being biased by a return force generated by the pivotal connection structure 30 (more specifically, the joint member 33) if it pivots about the second pivot axis 62 away from the rest position RP.

In FIG. 9, after shaving starts, the blade unit 11 receives a force F1 which is applied from the skin and thus it leans in the direction D1 to reach the lean position LP which is indicated by the moved pivot axis 66 in FIG. 9. This lean causes a strain at the joint member 33 of the pivotal connection structure 30. In response to the strain (and due to the resilient nature of the joint member 33), the joint member 33 of the pivotal connection structure 30 generates a reverse force F2 which is applied to the first member 31. The reverse force F2 is transmitted to the blade unit 11 through the first member 31 as a return force F3 in the direction D2. This return force F3 pushes back the blade unit 11 to the rest position RP.

Similarly, the blade unit 11 and the joint member 33 of the pivotal connection structure 30 work when the opposite force (to the force F1) is applied to the blade unit 11 from the skin during shaving.

The blade unit 11 has a rest position towards which the blade unit 11 is biased by a return force when pivoted about the second pivot axis 62 away from the rest position.

The return force generated by the joint member 33 of the pivotal connection structure 30 can be either liner or non-linear acting to return the blade unit 11 to the rest position RP. The torque range can be from about 0 to about 15 Nmm as the blade unit 11 pivots from its rest position RP about the second pivot axis 62 in either direction through the complete pivot range. Other torque ranges both larger and smaller may be used as desired. The torque can be varied depending on the elastic property of the material used in the joint member 33 of the pivotal connection structure 30. In the embodiment shown in FIG. 1, the torque range is from about 0 to about 15 Nmm.

The blade unit 11 can have a pivot range (about the second pivot axis 62) up to about 15° in either direction from the rest position. Other pivot ranges both larger and smaller may be used as desired. In the embodiment shown in FIG. 1, the blade unit 11 can have a pivot range about 15° in either direction from the rest position.

Figure 10:
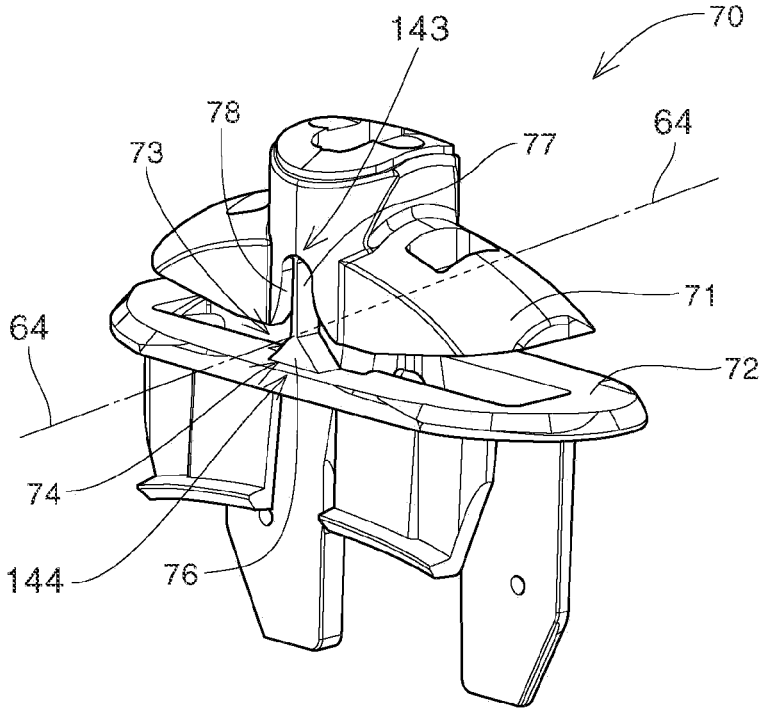
FIG. 10 is a perspective view of a pivotal connection structure which is used in another embodiment of the invention.
Figure 11:
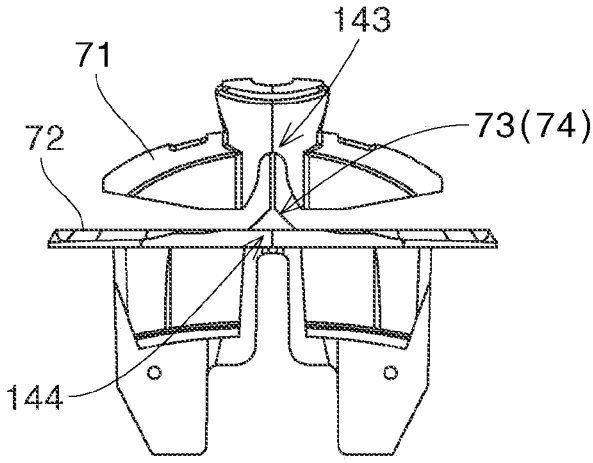
FIG. 11 is a front view of the pivotal connection structure shown in FIG. 10.
Figure 12:
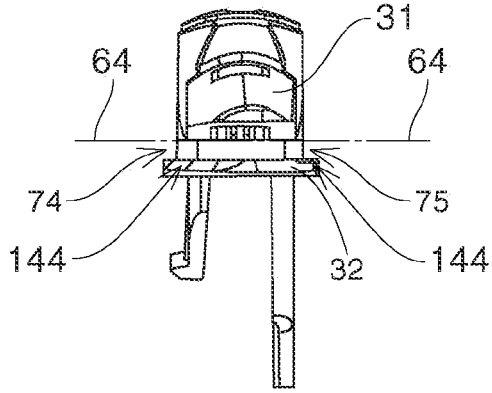
FIG. 12 is a side view of the pivotal connection structure shown in FIG. 10.

FIG. 10 is a perspective view of another pivotal connection structure 70 which is used in another embodiment of the invention. FIGS. 11 and 12 are front and side views of the pivotal connection structure shown in FIG. 10.

Similarly to the pivotal connection structure 30 shown in FIG. 4, the pivotal connection structure 70 includes a first member 71 which is connected to the blade unit 11, and a second member 72 which is connected to the handle casing 16. Each of the first and second members 71 and 72 has joint portions 143 and 144. The pivotal connection structure 70 further includes a joint member 73 for jointing, in a hinged manner, the joint portion 143 of the first member 71 with the joint portion 144 of the second member 72. The joint member 73 (as a whole) has an elongated shape such that it constitutes the hinge axis 64 disposed between the joint portions 143 and 144 of the first and second members 71 and 72. In this embodiment, the joint member 73 includes two separated joint elements 74 and 75 which are disposed along the hinge axis 64 which coincides with the second axis 62 (i.e., the perpendicular pivot axis).

Compared with the pivotal connection structure 30 shown in FIG. 4, each of the joint elements 74 and 75 has a different shape and structure from that of the joint elements 34 and 35. More specifically, each of the joint elements 74 and 75 includes a base member 76 having a triangular prism shape, and an elastic plate member 77 extending from the base member 76. In addition, the first member 71 has a notch portion 78 where the distal end of the elastic plate member 77 is connected. The base member 76 of the joint element 74 is jointed to the joint portion 144 of the second member 72. The elastic plate member 77 is formed by a resilient material such as those used for the joint member 33. In the embodiment shown in FIG. 4, the elastic plate member 77 is a leaf spring formed by a metal material (e.g., a stainless-steel material).

This pivotal connection structure 70 works in a similar manner to the pivotal connection structure 30 shown in FIG. 4 due to the resilient nature of the joint member 73 (i.e., the joint elements 34 and 35). Thus, the pivotal connection structure 70 is constructed such that the joint member 73 has the hinge axis 64 disposed between the joint portions 143 and 144 of the first and second members 71 and 72, which works as the perpendicular pivot axis 62. The blade unit 11 can be biased by a return force when pivoted about the pivot axis 62 away from the rest position.

Before assembling the pivotal connection structure 70, each of the joint elements 74 and 75 is prepared independently from the assembling process of the pivotal connection structure 70. So, the resilience property of the joint elements 74 and 75 can be controlled easily (compared with, for example, the pivotal connection structure 30 shown in FIG. 4 which is formed by an injection molding process of a thermo plastic material).

In addition, since the pivotal connection structure 70 for a pivotal movement about the perpendicular pivot axis 62 can be formed by a simple structure, the safety razor can be produced by a simpler manufacturing process, compared to the prior art technologies.

Figure 13:
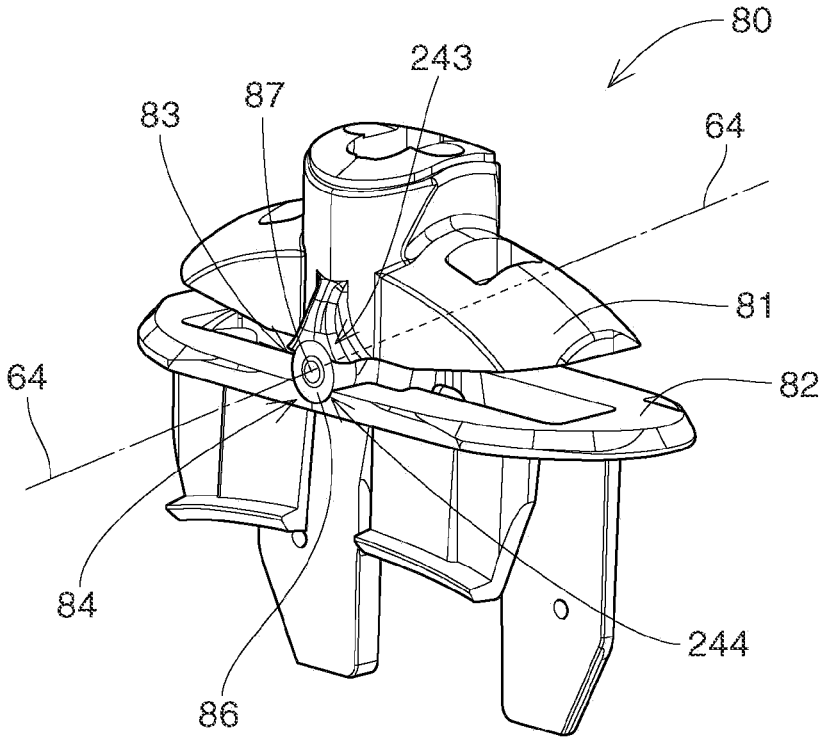
FIG. 13 a perspective view of a pivotal connection structure which is used in a yet another embodiment of the invention.
Figure 14:
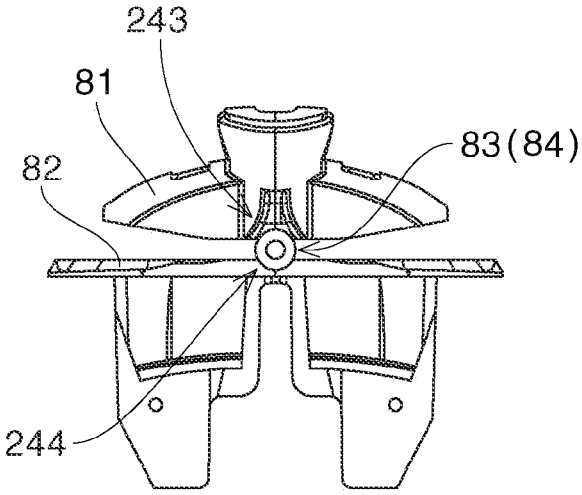
FIG. 14 is a front view of the pivotal connection structure shown in FIG. 13.
Figure 15:
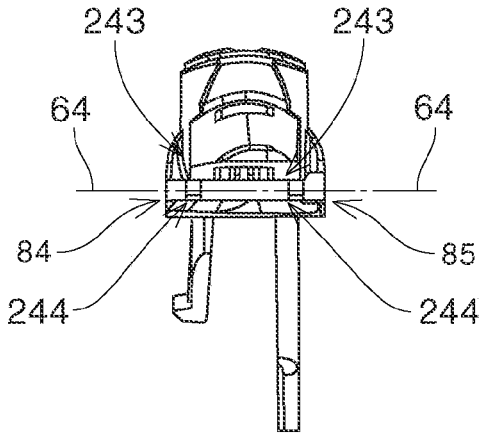
FIG. 15 is a side view of the pivotal connection structure shown in FIG. 13.

FIG. 13 is a perspective view of a yet another pivotal connection structure 80 which is used in another embodiment of the invention. FIGS. 14 and 15 are front and side views of the pivotal connection structure shown in FIG. 13. Similarly to the pivotal connection structure 30 shown in FIG. 4, the pivotal connection structure 80 includes a first member 81 which is connected to the blade unit 11, and a second member 82 which is connected to the handle casing 16. Each of the first and second members 81 and 82 has joint portions 243 and 244. The pivotal connection structure 80 further includes a joint member 83 for jointing, in a hinged manner, the joint portion 243 of the first member 81 with the joint portion 244 of the second member 82. The joint member 83 (as a whole) has an elongated shape such that it constitutes the hinge axis 64 disposed between the joint portions 243 and 244 of the first and second members 81 and 82. In this embodiment, the joint member 83 includes two separated joint elements 84 and 85 which are disposed along the hinge axis 64 which coincides with the second axis 62 (i.e., the perpendicular pivot axis).

Compared with the pivotal connection structure 30 shown in FIG. 4, each of the joint elements 84 and 85 has a different shape and structure. More specifically, each of the joint elements 84 and 85 includes a bearing 86 having a cylindrical shape fixed to the second member 82, and a pivot shaft 87 having one end fixed to the first member 81 and the other end inserted into the bearing 86. In each of the joint elements 84 and 85, the pivot shaft 87 can pivot within the bearing 86 in response to the shaving action.

Thus, the pivotal connection structure 80 is constructed such that the joint member 83 has the hinge axis 64 disposed between the joint portions 243 and 244 of the first and second members 81 and 82, which works as the perpendicular pivot axis 62.

Figure 16:
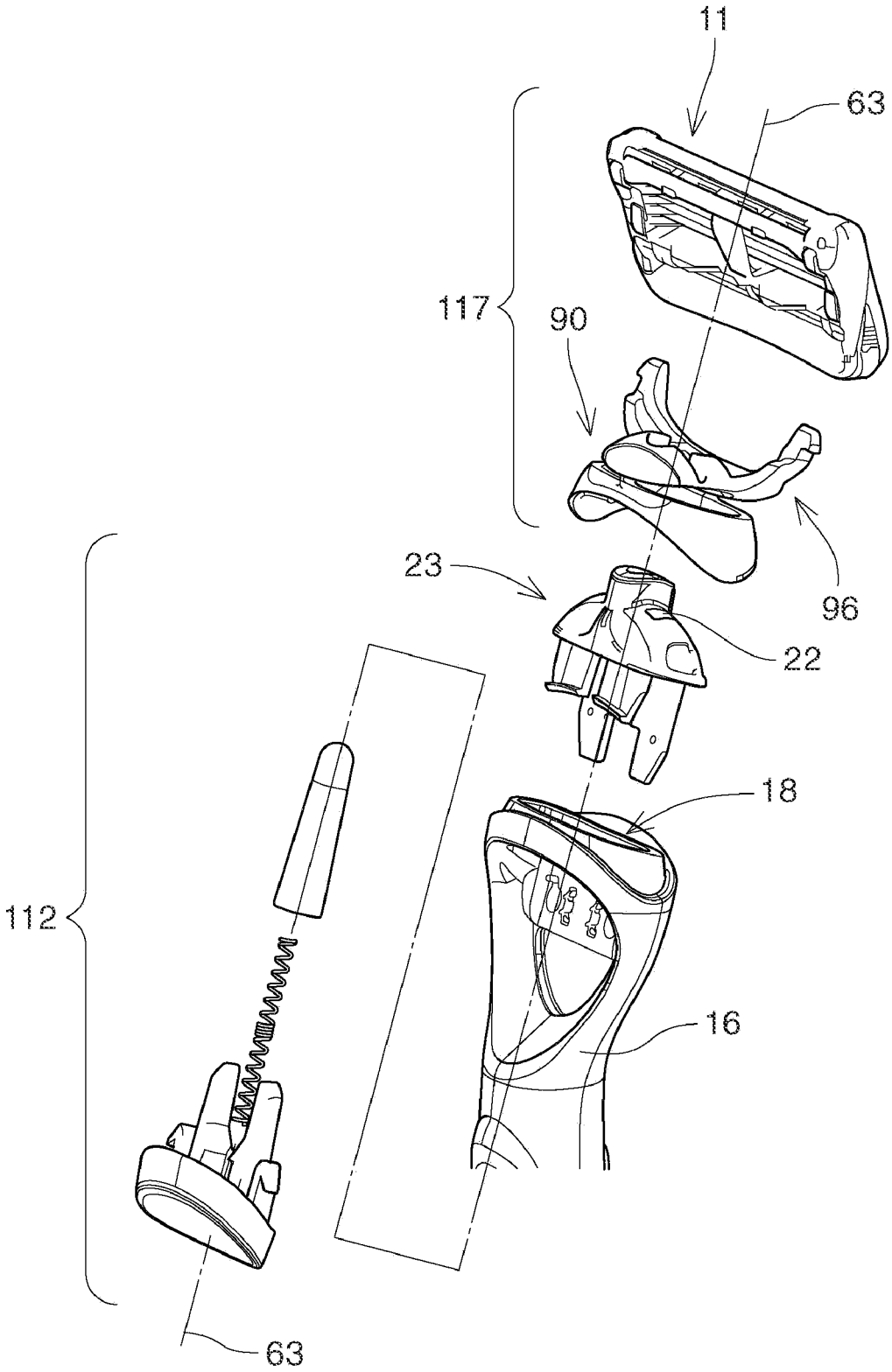
FIG. 16 is an exploded perspective view of a safety razor which is a yet another embodiment of the invention.

FIG. 16 is an exploded perspective view of a safety razor which is a yet another embodiment of the invention. Referring to FIG. 16, this safety razor includes a shaving cartridge 117 which is to be attached to a handle unit 112 of the safety razor. The shaving cartridge 117 includes a blade unit 11, a connecting member 96 and a pivotal connection structure 90 which is to be connected to the handle unit 112. In this embodiment, the blade unit 11 is connected to the handle unit 112 through the connecting member 96 and the pivotal connection structure 90 for a pivotal movement about a perpendicular pivot axis 62 (not shown in FIG. 16) for following the skin contours of a user during shaving.

The shaving cartridge 117 is attached and detached to the handle unit 112 through a latch mechanism. Specifically, the handle unit 112 includes a connecting member 23 having two concave portions 22 formed on its upper surface. The second member 92 has two latch arms (not shown in Figs.) at its inner and lower structure facing the connecting member 23, which latch against the two concave portions 22 formed on the connecting member 23.

The connecting member 96 has a body 97 and a pair of arms 98 extending outwardly from the body 97. Each of the arms 98 has a finger 99 which is pivotally connected to the blade unit 11 by insertion into pivot bearings (not shown in FIG. 16) formed in the back of the frame 13 of the blade unit 11, and allow the blade unit 11 to pivot about the axis 61 (FIG. 1) relative to the handle unit 112.

Figure 17:
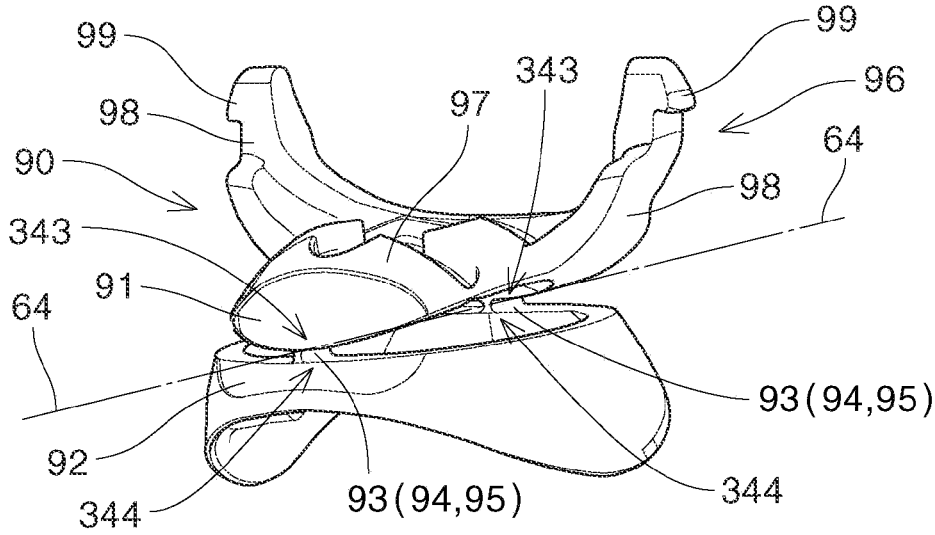
FIG. 17 a perspective view of the pivotal connection structure the pivotal connection structure shown in FIG. 16.
Figure 18:
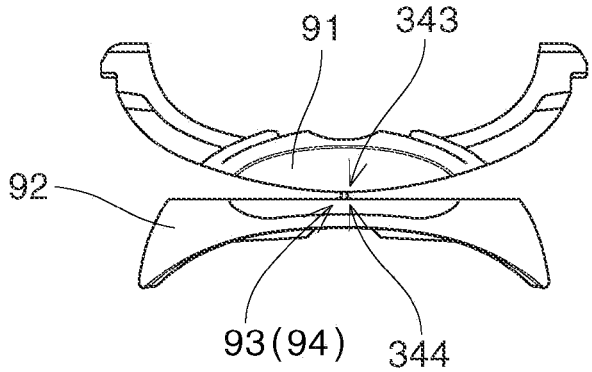
FIG. 18 is a front view of the pivotal connection structure shown in FIG. 16.
Figure 19:
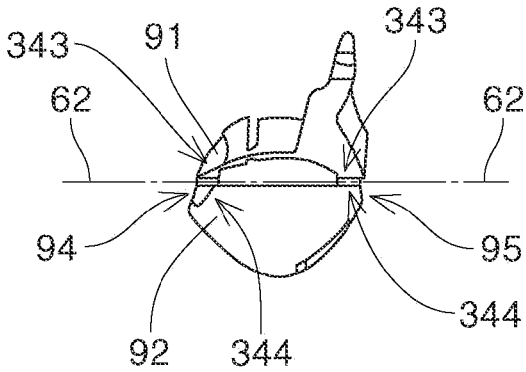
FIG. 19 is a side view of the pivotal connection structure shown in FIG. 16.

FIG. 17 is a perspective view of the pivotal connection structure shown in FIG. 16. FIGS. 18 and 19 are front and side views of the pivotal connection structure 90 shown in FIG. 16. Referring to FIGS. 17-19, the pivotal connection structure 90 includes a first member 91 which is connected to the blade unit 11; a second member 92 which is connected to the handle unit 112 (or the handle casing); and a joint member 93 for jointing, in a hinged manner, the first member 91 with the second member 92. The joint member 93 has an elongated shape such that it constitutes a hinge axis 62 between the first and second members 91 and 92.

It should be noted that the joint member 93 works similarly to the joint member 33 shown in FIG. 4 due to the resilient nature of the joint member 93 (i.e., the joint elements 34 and 35). Thus, the pivotal connection structure 90 is constructed such that the joint member 93 has the hinge axis 64 disposed between the joint portions 343 and 344 of the first and second members 91 and 92, which works as the perpendicular pivot axis 62. The blade unit 11 can be biased by a return force when pivoted about the pivot axis 62 away from the rest position.

In the embodiment shown in FIG. 17, the first member 91, the second member 92 and the joint member 93 are formed by an identical material such as a thermo plastic material (e.g., a polyphenylene-ether (PPE) material) by using an injection molding process. Alternatively, the first member 31, the first member 91, the second member 92 and the joint member 93 can be formed by two or three different materials.

Since the pivotal connection structure 90 for a pivotal movement about the perpendicular pivot axis 62 can be formed by a simple structure, the safety razor can be produced by a simpler manufacturing process, compared to the prior art technologies.

Modifications to the described embodiments are of course possible without departing from the principles of the invention. It is to be understood, therefore, that the specifically described embodiments are given by way of non limiting example only and it is intended that the invention should be limited only by the claims which follow.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and 5 modifications can be made without departing from the spirit and scope of the invention. It is therefore intended to cover in the appended claims all such changes and modifications that are within the scope of this invention.

What is claimed is:

1. A safety razor comprising:

a blade unit having at least one blade having a cutting edge;

a handle casing;

a pivotal connection structure including:

a first member connected to the blade unit;

a second member connected to the handle casing; and a joint member comprising a plurality of separated joint elements which are disposed along the perpendicular pivot axis, and which connect the first member and the second member that facilitates movement of the first member relative to the second member about a hinge axis that is substantially perpendicular to the at least one cutting edge, wherein the first member has a joint portion, the second member has a joint portion, and the joint member has a thinner wall section toward the hinge axis than toward at least one of the joint portions of the first and second members.

2. The safety razor of claim l wherein the joint member includes a plurality of separated joint elements which are disposed along the perpendicular pivot axis.

3. The safety razor of claim 1 wherein the first and second members and the joint member are formed by an identical material.

4. The safety razor of claim 3 wherein the joint member is formed by a unitary material.

5. The safety razor according of claim 3 wherein the first and second members and the joint member are formed by an injection molding process of a thermo plastic material.

6. The safety razor of claim l wherein at least one of the first and second members has a convexly curved face facing the other of the first and second members.

7. The safety razor of claim 1 wherein the blade unit has a pivotal connection structure for a pivotal movement about a parallel pivot axis which is substantially parallel to the at least one blade.

8. The safety razor of claim 7 wherein the pivotal connection structure includes a pair of latch arms that secure the pivotal connection structure to the handle casing.

9. The safety razor of claim 7 wherein the blade unit includes a frame with a cam surface and the handle unit includes a spring-biased plunger with a rounded distal end that contacts the cam surface at a location spaced from the parallel pivot axis to impart a biasing force to the frame.

10. The safety razor of claim 1 further comprising a shaving cartridge which is detachable from the handle unit, wherein the shaving cartridge includes the blade unit and the pivotal connection structure.

11. The safety razor of claim 1 further comprising a shaving cartridge which is detachable from the handle unit, wherein the shaving cartridge includes the blade unit and the handle unit includes the pivotal connection structure.

12. The safety razor of claim 1 wherein the separated joint elements include a triangular prism shaped base member and an elastic plate member extending from the base member.

13. The safety razor of claim 12 wherein the elastic plate member is a leaf spring formed by a metal material.

14. The safety razor according to claim 1, wherein each of the plurality of separated joint elements includes a bearing having a cylindrical shape fixed to the second member and a pivot shaft having one end fixed to the first member and the other end inserted into the bearing.

15. A safety razor comprising a blade unit having at least one blade having a cutting edge, a handle unit having a handle casing, and a pivotal connection structure disposed between the blade unit and the handle casing, the blade unit being connected to the handle casing through the pivotal connection structure for a pivotal movement relative thereto about a perpendicular pivot axis which is substantially perpendicular to the at least one cutting edge for following the skin contours of a user during shaving, the pivotal connection structure including;

(a) a first member connected to the blade unit, the first member having a joint portion, (b) a second member connected to the handle casing, the second member having a joint portion, and (c) a joint member for jointing, in a hinged manner, the joint portion of the first member with the joint portion of the second member, the pivotal connection structure is constructed such that the joint member has a hinge axis disposed between the joint portions of the first and second members, which works as the perpendicular pivot axis, the joint member includes a plurality of separated joint elements which are disposed along the perpendicular pivot axis wherein each of the plurality of separated joint elements includes a bearing having a cylindrical shape fixed to the second member, and a pivot shaft having one end fixed to the first member and the other end inserted into the bearing.

16. The safety razor according to claim 15, wherein the first and second members and the joint member are formed by an injection molding process of a thermo plastic material.

17. The safety razor according to claim 15, wherein at least one of the first and second members has a convexly curved face facing the other of the first and second members.

18. The safety razor according to claim 15, further comprising a shaving cartridge which is detachable from the handle unit, wherein the shaving cartridge includes the blade unit and the pivotal connection structure.

19. The safety razor according to claim 15, further comprising a shaving cartridge which is detachable from the handle unit, wherein the shaving cartridge includes the blade unit and the handle unit includes the pivotal connection structure.

* * * * *